US005653341A

United States Patent [19]

Miret

[11] Patent Number: 5,653,341

[45] Date of Patent: Aug. 5, 1997

[54] SLEEVE ARRANGEMENT

[75] Inventor: Emili Requena Miret, Igualada, Spain

[73] Assignee: Riverwood International Corporation, Atlanta, Ga.

[21] Appl. No.: 532,786

[22] PCT Filed: Apr. 5, 1994

[86] PCT No.: PCT/GB94/00725

§ 371 Date: Nov. 1, 1995

§ 102(e) Date: Nov. 1, 1995

[87] PCT Pub. No.: WO94/22737

PCT Pub. Date: Oct. 13, 1994

[30] Foreign Application Priority Data

Apr. 7, 1993 [GB] United Kingdom ..... 9307316

[51] Int. Cl.[6] ..... B65D 75/06

[52] U.S. Cl. ..... 206/434; 206/431; 229/103.2

[58] Field of Search ..... 206/427, 429, 206/431, 434, 140, 148, 149, 156, 157; 229/198.2, 103.2

[56] References Cited

U.S. PATENT DOCUMENTS

| | | | |
|---|---|---|---|
| 2,768,741 | 10/1956 | Currie | 206/149 |
| 3,081,928 | 3/1963 | Chidsey, Jr. et al. | 206/434 |
| 3,156,404 | 11/1964 | Wood | 206/434 |
| 3,175,682 | 3/1965 | Forrer | 206/157 |
| 3,292,843 | 12/1966 | Chidsey, Jr. et al. | 206/434 |
| 3,314,590 | 4/1967 | Tolaas | 206/434 |
| 3,653,580 | 4/1972 | Mahon | 206/434 |
| 3,670,879 | 6/1972 | Williard . | |
| 4,671,451 | 6/1987 | Yeaman, Sr. . | |
| 4,693,412 | 9/1987 | Yeaman, Sr. . | |
| 5,240,173 | 8/1993 | Dagostine | 206/434 |

*Primary Examiner*—Paul T. Sewell
*Assistant Examiner*—Luan K. Bui
*Attorney, Agent, or Firm*—Isaf, Vaughan & Kerr

[57] ABSTRACT

A paperboard sleeve (10) for wrapping a plurality of brick-shaped containers (11) is disclosed. The sleeve has two opposed and interlocking base panels (21, 22) with flaps (32) formed as a part thereof, the flaps being sized and shaped to be folded back against protruding base tucks (13) formed on the bases of the containers. The engagement of the flaps against the base tucks on the bottom of the containers prevents the movement of the containers through the open ends of the paperboard sleeve after it is formed about the containers.

8 Claims, 4 Drawing Sheets

SLEEVE ARRANGEMENT

BACKGROUND OF THE INVENTION

This invention relates to sleeves for wrapping a plurality of parallelepiped containers each having a pair of protruding angled base tucks. Such containers include those produced under the registered trade mark "Tetra Brik".

SUMMARY OF THE INVENTION

According to a first aspect of the present invention there is provided an open-ended paperboard sleeve for wrapping a plurality of parallelepiped containers, which containers each have a base panel incorporating a pair of protruding angled base tucks, said sleeve comprising a top portion, two side portions and a base portion and incorporating flap means which in use are folded so as to lie generally between the base portion and the base panel of at least one of said containers so as to cooperate with one or more of said base tucks of at least one container to prevent withdrawal of the containers through the open ends of the sleeve.

Preferably the flap means comprises one or more flaps each of which is formed from either a side portion or the base portion or a combination of both in the region of the function between the base portion and the side portion and also when the flap spans the junction of the base portion and the side portion, the hinged connection between the side portion and the base portion does not continue across the flap which remains unfolded.

In preferred arrangements each flap has a 45° edge relative to the lengthwise axis of the sleeve for engagement with a 45° angled edge of its associated base tuck.

With a further embodiment the hinge line about which each flap is rotated into its in use position is generally parallel to the hinged connection between the base portion and the two side portions. Conveniently the base portion incorporates two bottom panels hingedly connected to respective side portions, which panels are joined together to close the sleeve and preferably the two bottom panels are formed with interlocking formations to join them together.

According to a second aspect of the present invention there is provided a blank for producing the above described sleeves.

An embodiment of the present invention will now be described in more detail. The description makes reference to the accompanying diagrammatic drawings.

DETAILED DESCRIPTION

Figure 1:
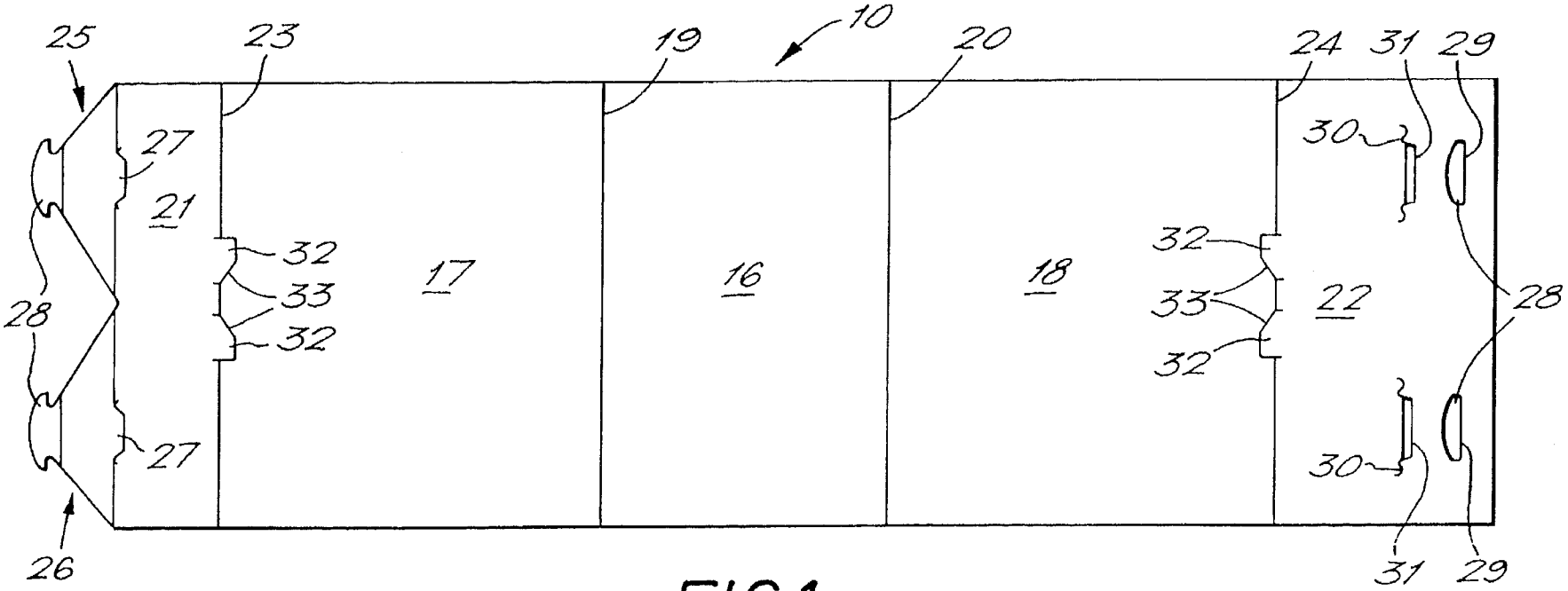
FIG. 1 is a view of a blank for producing the sleeve according to the present invention.

In the figures there is shown a paperboard blank 10 for making a sleeve for wrapping a plurality of brick-shaped parallelepiped containers 11 which may contain liquids such as fruit juice. Such containers are well known and one particular container 11 is sold under the registered trade mark "Tetra-Brik". On the base of such a container 11 the corners are tucked back under the base at 13 about a hinge line 12 and then secured to the base. These tucks 13 protrude slightly from the remaining area of the base and have edges 14 which are angled at about 45° relative to the axes of the base.

Figure 2:
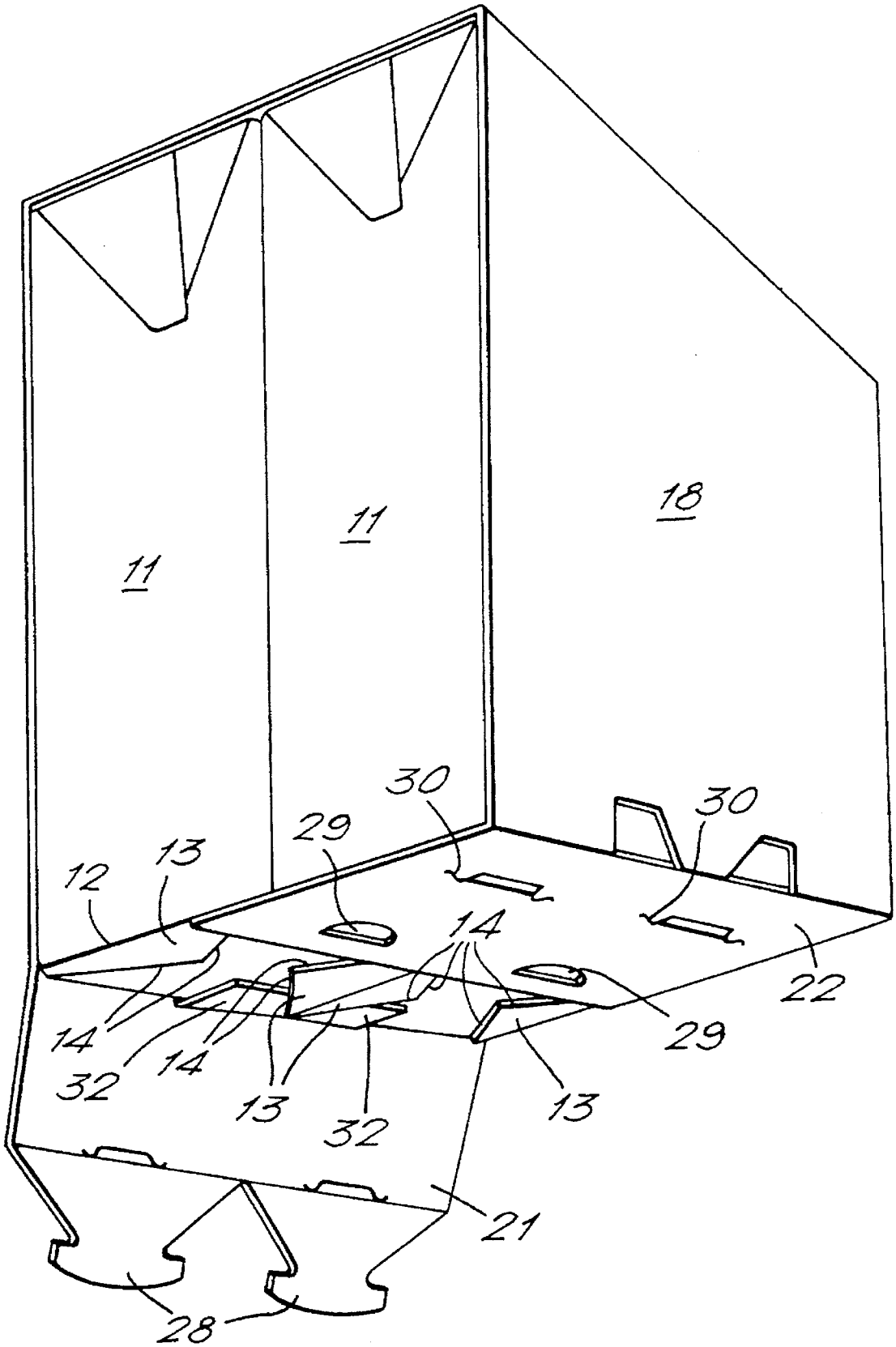
FIG. 2 is a perspective view from below of the sleeve during assembly around a plurality of containers.
Figure 3:
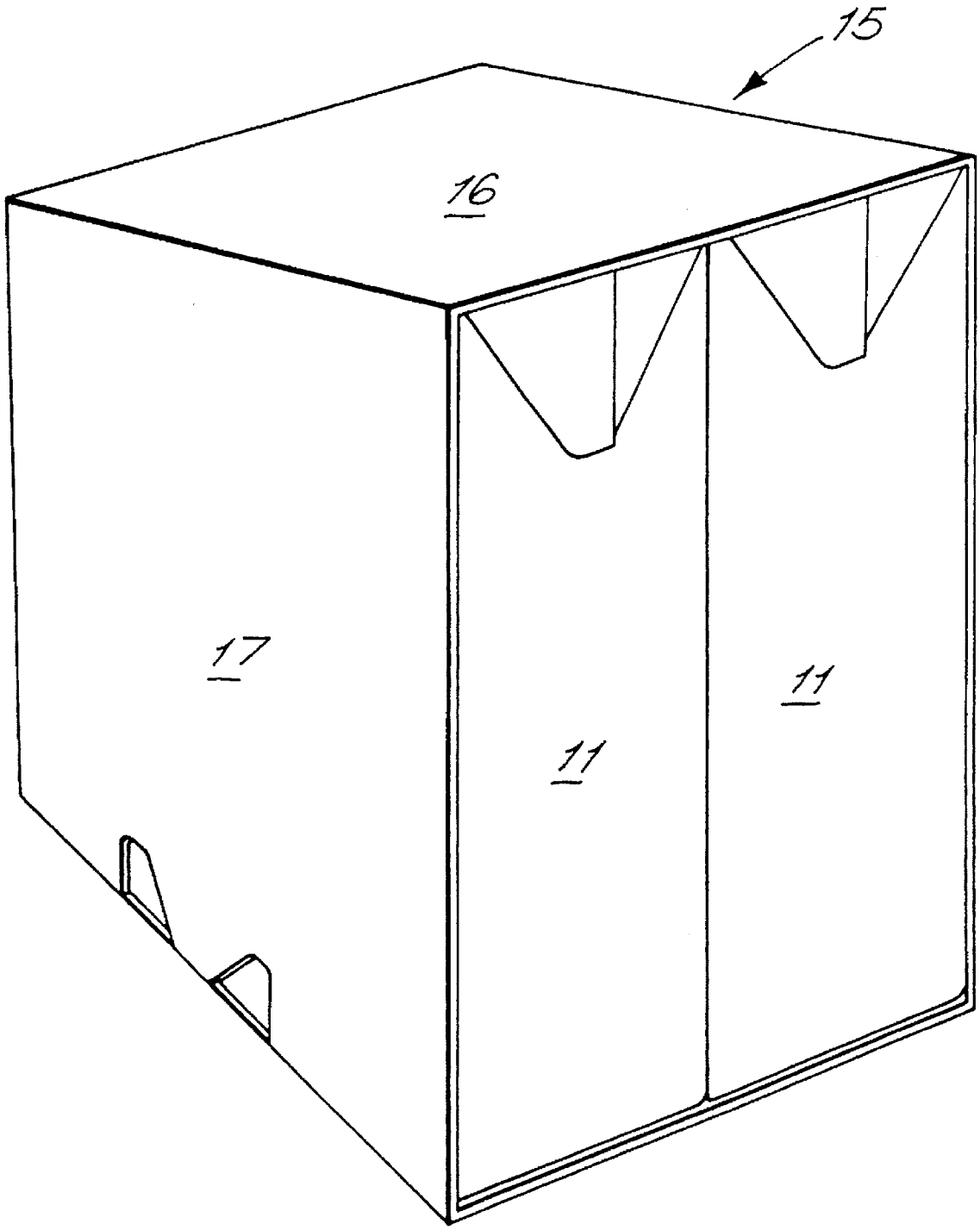
FIG. 3 is a perspective view from above of the assembled sleeve.

In a typical multipack 15, four containers 11 are arranged in a rectangular 2×2 array as shown most clearly in FIG. 2. The blank 10 for the sleeve has a top portion 16 for lying against the top panels (not illustrated) of the containers 11, two side portions 17, 18 hingedly connected at 19, 20 to opposite side edges of the top portion 16 and two bottom panels 21, 22 hingedly connected at 23, 24 to the bottom edges of the side panels. The bottom panel 21 is formed with hinged locking panels 25, 26 each of which has a primary locking tab 27 and a secondary locking tab 28 whilst the bottom panel 22 is formed with a pair of cutouts 28 defining locking shoulders 29 and with a pair of cut lines 30 incorporating hinge lines 31.

The blank 10 is also formed with flaps 32 in the region of the hinge lines 23, 24 which are interrupted by the flaps 32. Each flap 32 spans the associated hinge line 23, 24 and the flaps 32 are provided on either side Of the central transverse axis (not illustrated) of the sleeve. Each flap is formed with an inward facing edge 33 at 45° to the central transverse axis.

To apply the blank 10 to the containers 11 the top portion 16 is arranged over the tops (not illustrated) of the containers 11 and the side portions of the blank 17, 18 are folded towards the sides of the array of containers 11 along hinged connections 19, 20, but the bottom panels 21, 22 are bent outwards during this procedure. This ensures that the flaps 32 remain aligned with the bottom panels 21, 22 so that when the side portions 17, 18 engage the sides of the array of containers 11 the flaps are not trapped by the side portions 17, 18. The bottom panels 21, 22 are then folded along hinged connections 23, 24 under the bases of the containers such that the flaps 32 are trapped between the containers 11 and the bottom panels 21, 22. In these positions the flaps lie alongside the angled edges 14 of the base tucks 13 of the containers 11 and against the non protruding portions of the bases of the containers 11. The primary and secondary locking tabs 27, 28 are then engaged with the locking shoulders 29 and cut lines, respectively 30 in the known manner, thereby securing the blank 10 into its sleeve formation around the array of containers 11.

The sleeve of course has open ends but the flaps 32 prevent the containers 11 from sliding out of the ends of folded paperboard blank 10 because each flap 32 engages the base tuck 13 of its associated container 11 and prevents movement of the container 11 relative to the sleeve in the direction of the adjacent open end.

Figure 4:
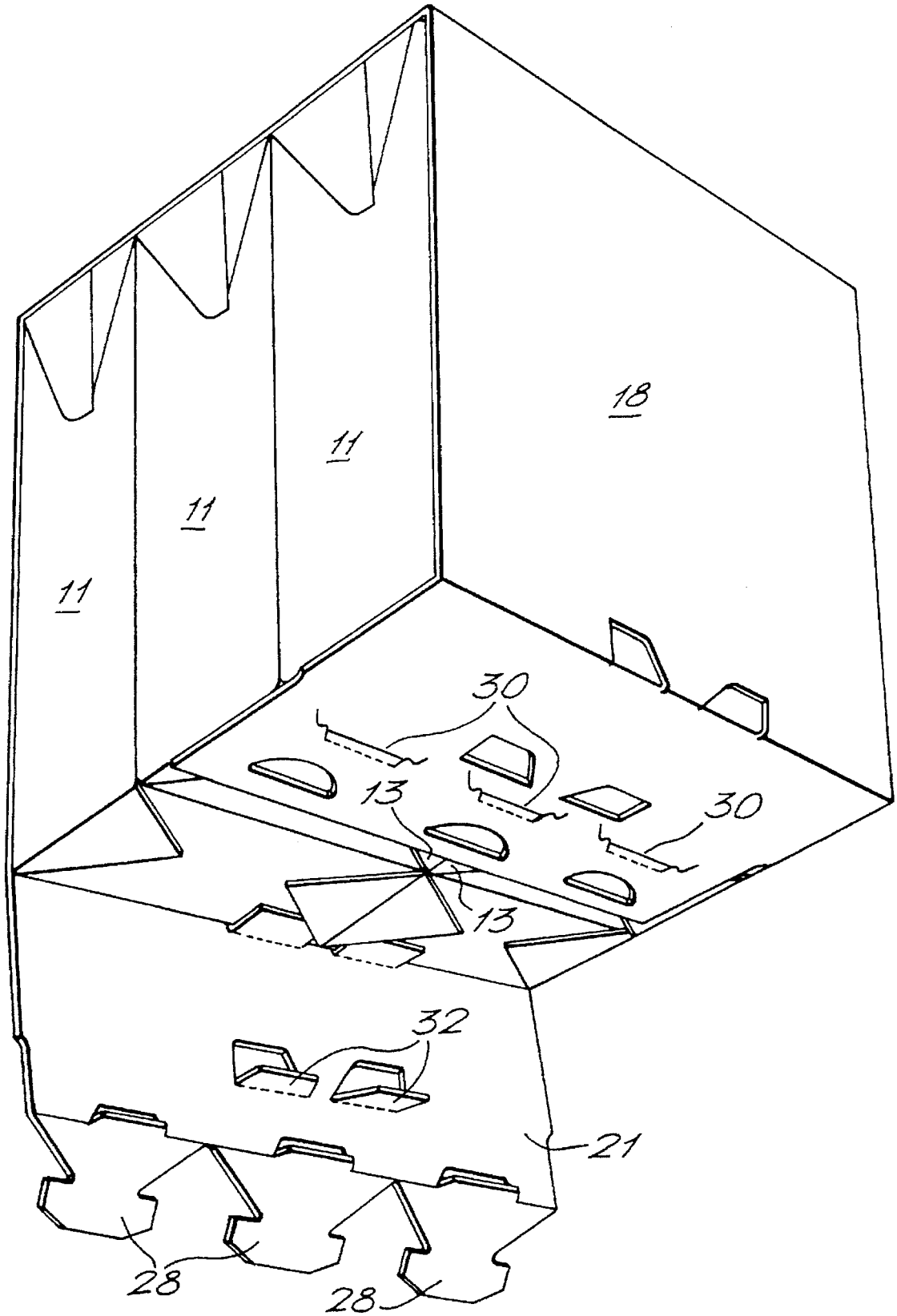
FIG. 4 is a perspective view from below of another sleeve during assembly.

It will of course be readily appreciated that the concept would be applied to other arrays of similar containers. For example a 2×3 array (not illustrated) with two containers adjacent the open ends would still require only four flaps 32 to secure only the four containers adjacent the ends. Extra flaps, however, could be provided to increase security. Also other arrays such as 3×3 are possible, one example of which is shown in FIG. 4. In this arrangement suitable hinged flaps 32 are provided in the bottom panel so as also to engage the base tucks 13 of the middle row of containers. It will be appreciated that any rectangular array of containers can be provided for.

Also the actual form and precise location of the flaps 32 can be changed, although best results are obtained with an edge 33 which corresponds with the angled edge 14 of the tuck 13. Whilst the flaps 32 are shown in the above example as being cut primarily from the side portions 17, 18 it is also possible that the flaps could be cut entirely from the bottom panels or the side portions as well as any combination thereof. Also it is possible to use a single flap of suitable shape to secure two or more containers 11 such that it is not necessary to have one flap 32 per container 11 being positively secured.

In addition, the illustrated interconnecting means namely tabs 27, 28 shoulder 29, and cut line 30, between the bottom panels could be replaced by other interlocking formations or even adhesive. Furthermore the interlocking could be provided on any face of the sleeve and need not be provided adjacent the flaps.

While a preferred embodiment of the invention has been disclosed in the foregoing specification and drawings, it will be understood by those skilled in the art that variations and modifications thereof can be made without departing from the spirit and scope of the invention, as set forth in the following claims.

I claim:

1. An open-ended paperboard sleeve in which a plurality of parallelepiped containers are packaged, each of the containers having a planar base panel and a pair of opposed, protruding angled base tucks folded over onto the base panel, said sleeve comprising;

a top portion, said top portion having a pair of opposed side edges;

two side portions, one each of said side portions being hingedly connected to the top portion along one each of said side edges, respectively; and a first base portion and an opposed second base portion hingedly connected to one each of said side portions, respectively, said first base portion including at least one flap disposed along a hinge line formed in the first base portion, said at least one flap being defined in the side portion to which said first base portion is hingedly connected and being sized and shaped to be folded over onto the base panel of at least one of the containers and to generally lie intermediate said first base portion and the base panel of the at least one container in juxtaposition with at least one of the base tucks of the at least one container to prevent withdrawal of the containers through the open ends of the sleeve.

2. The sleeve as claimed in claim 1, wherein said at least one flap has at least one angled side edge, said angled side edge being angled at a 45° angle relative to the length of the sleeve along said hinge line for engagement with one of the angled base tucks of the at least one container.

3. The sleeve as claimed in claim 1, wherein said at least one flap is at least partially rotated about said hinge line into juxtaposition with one of the angled base tucks of the at least one container.

4. The sleeve as claimed in claim 1, and wherein the first and the second base portions are folded toward each other and joined together to lock said sleeve about the containers.

5. The sleeve as claimed in claim 4, wherein said first and said second base portions are formed with interlocking tabs and locking shoulders, respectively, for locking said base portions together.

6. The sleeve of claim 1, wherein said at least one flap is defined in said first base portion so that said at least one flap extends across the hinged connection of the first base portion and the side portion to which said first base portion is hingedly connected prior to the folding of the first base portion with respect to the side portion to lock said sleeve about the containers.

7. A wrap-type paperboard carrier, the carrier having a pair of spaced and open ends, in which a plurality of generally parallelepiped containers are packaged adjacent one another, the combination comprising;

each of the containers having a generally planar base, and a pair of opposed and protruding angled base tucks folded over onto the base of the container;

said carrier having a top panel extending between the ends of the carrier, said top panel having a pair of opposed and elongated side edges, two side panels, one each of said side panels being hingedly connected to the top panel along one each of said side edges, respectively, and a first base panel and an opposed second base panel, each said base panel being hingedly connected to one each of said side panels, respectively;

wherein said first base panel includes a first pair of spaced flaps formed thereon, one each of said first pair of flaps being positioned on the first base panel with respect to each end of said carrier, each said flap extending along a common flap hinge line formed on the first base panel, the flaps extending from said hinge line into and being defined within the side panel to which said first base panel is hingedly connected, each said flap being sized and shaped to be folded over onto the base panel of the containers at each open end of said carrier, respectively, as the first and the second base panels are folded over the bases of the containers toward each other so that said flaps are generally held between the first base panel and the bases of the containers at the ends of said carrier and are juxtaposed with at least one of the base tucks of each of the containers at the open ends of said carrier, respectively, to prevent the withdrawal of the containers through the open ends thereof.

8. The carrier of claim 7, wherein said second base panel includes a second pair of spaced flaps formed thereon and spaced opposite of said first pair of flaps, one each of said second pair of flaps being positioned on the second base panel with respect to each end of said carrier, each said flap extending along a common flap hinge line formed on the second base panel, the flaps extending from said hinge line into and being defined within the side panel to which said second base panel is hingedly connected, each said flap being sized and shaped to be folded over onto the base panel of the containers at each open end of said carrier, respectively, as the first and the second base panels are folded over the bases of the containers toward each other so that said flaps are generally held between the second base panel and the bases of the containers at the ends of said carrier and are juxtaposed with at least one of the base tucks of each of the containers at the open ends of said carrier, respectively, to prevent the withdrawal of the containers through the open ends thereof.

* * * * *